US010035574B2

(12) United States Patent
Montgomery et al.

(10) Patent No.: US 10,035,574 B2
(45) Date of Patent: Jul. 31, 2018

(54) PROPULSION SYSTEM FOR A WATERCRAFT

(71) Applicant: Liquid Waste Technology, LLC, New Richmond, WI (US)

(72) Inventors: Aaron Shawn Montgomery, New Richmond, WI (US); Kurtis Michael Syverson, Afton, MN (US); Brian John Lindahl, Somerset, WI (US); Todd Alan Zuberbier, Somerset, WI (US); Ryan Patrick Horton, Leawood, KS (US); Michael Todd Young, Bonner Springs, KS (US)

(73) Assignee: Liquid Waste Technology, LLC, New Richmond, WI (US)

( * ) Notice: Subject to any disclaimer, the term of this patent is extended or adjusted under 35 U.S.C. 154(b) by 182 days.

(21) Appl. No.: 15/331,085

(22) Filed: Oct. 21, 2016

(65) Prior Publication Data

US 2017/0113771 A1 Apr. 27, 2017

Related U.S. Application Data

(60) Provisional application No. 62/244,346, filed on Oct. 21, 2015.

(51) Int. Cl.

| | |
|---|---|
| ***B63H 19/08*** | (2006.01) |
| ***E02F 5/28*** | (2006.01) |
| ***E02F 7/10*** | (2006.01) |

(52) U.S. Cl.

CPC ..... *B63H 19/08* (2013.01); *E02F 5/282* (2013.01); *E02F 7/10* (2013.01)

(58) Field of Classification Search

CPC .... B63H 19/08; B63H 5/02; B63H 2005/025; B63H 5/03; B63H 5/04; E02F 5/006; E02F 9/026; E02F 9/045

See application file for complete search history.

(56) References Cited

U.S. PATENT DOCUMENTS

| | | | | | |
|---|---|---|---|---|---|
| 1,819,409 | A * | 8/1931 | Du Mond | ..... | B63H 1/04 416/86 |
| 2,358,937 | A * | 9/1944 | Melton | ..... | B63H 1/04 416/196 A |
| 2,612,957 | A * | 10/1952 | Knipping | ..... | B63H 1/04 416/198 R |

(Continued)

FOREIGN PATENT DOCUMENTS

| | | | | |
|---|---|---|---|---|
| FR | 1040776 | A * | 10/1953 | ..... B63H 19/04 |
| GB | 1159010 | A * | 7/1969 | ..... B63B 3/13 |

*Primary Examiner* — Matthew D. Troutman

(74) *Attorney, Agent, or Firm* — Hovey Williams LLP

(57) ABSTRACT

A watercraft propulsion system for moving a watercraft along a waterway having a bottom and a surface, wherein the watercraft presents a port side and a starboard side. The watercraft propulsion system comprises a boom assembly having a proximal end and a distal end, with the proximal end being rotatably coupled with the watercraft. The watercraft additionally comprises a wheel mounted to the distal end of the boom. The wheel includes at least one generally radially-extending blade assembly, with the blade assembly comprising a primary blade and a secondary blade. The secondary blade extends at an angle with respect to the primary blade so as to present a fluid channel between the primary blade and the secondary blade.

20 Claims, 11 Drawing Sheets

(56) References Cited

U.S. PATENT DOCUMENTS

| | | | | | |
|---|---|---|---|---|---|
| 2,711,708 | A * | 6/1955 | Thornburg | B63H 5/02 | 440/91 |
| 2,812,737 | A * | 11/1957 | Hoover | B63H 19/08 | 280/92 |
| 3,740,098 | A * | 6/1973 | Lachnit | E02F 3/9212 | 299/8 |
| 4,416,106 | A * | 11/1983 | Hawk | A01D 44/00 | 56/8 |
| 5,782,660 | A * | 7/1998 | Brickell | B63H 5/02 | 440/36 |
| 6,755,701 | B2 * | 6/2004 | Dornier, II | B60F 3/0061 | 37/307 |
| 6,814,636 | B2 * | 11/2004 | Nolen | B63H 5/02 | 440/90 |
| 6,948,881 | B1 * | 9/2005 | Fredriksson | B63B 1/125 | 405/128.5 |
| 8,056,270 | B1 * | 11/2011 | Maitlen | E02F 3/8841 | 37/345 |
| 2004/0127115 | A1 * | 7/2004 | Nolen | B63H 5/02 | 440/53 |
| 2008/0227343 | A1 * | 9/2008 | Averett | B60F 3/0007 | 440/12.5 |
| 2012/0094554 | A1 * | 4/2012 | Drinkard | B63H 5/02 | 440/6 |

* cited by examiner

PROPULSION SYSTEM FOR A WATERCRAFT

CROSS-REFERENCE TO RELATED APPLICATION

This non-provisional patent application claims priority benefit to U.S. Provisional Patent Application Ser. No. 62/244,346, filed Oct. 21, 2015, and entitled "PROPULSION SYSTSEM FOR A WATERCRAFT." The entirety of the above-identified provisional patent application is hereby incorporated by reference into this non-provisional patent application.

FIELD OF THE INVENTION

The present invention broadly concerns a system for propelling a dredge or other shallow-water watercraft by propulsion wheels, which are mounted for either surface propulsion or for bottom-engaging propulsion. More particularly, the present invention is concerned with propulsion wheels carried by booms mounted on the port and starboard sides of the watercraft, which may be raised and lowered and operated in a forward or a reverse direction and in multiple speeds to propel and position the watercraft.

BACKGROUND

Moving watercraft in shallow waterways such as ponds, lagoons and streams can be carried out in different manners. For example, boats have used paddlewheels, inboard or outboard engines coupled to screws, oars, paddles, or even poles to propel the craft along the water. A more challenging problem is presented when the watercraft is a dredge that includes a cutterhead to excavate the bottom of the waterway. The need to dig into the waterway bottom with the cutterhead and the output forces on discharge hoses extending from the dredge can be significant, thus, making the proposition of stabilizing the watercraft by the above-listed propulsion examples difficult. Environmental effects, such as strong winds, can also be a factor in trying to maintain the position and stability of the watercraft.

Another problem is presented when harvesting aquatic weeds such as water hyacinths. The tenacious nature of the weeds and the presences of large root masses with laterally extending roots complicates the problem of positioning and propelling watercraft that use screw drives.

One solution previously employed in positioning dredges or weed harvesting equipment involves the use of winches connected by cable to the shore. By the use of multiple cables connected to the shore, the watercraft can be held in position. Unfortunately, this solution requires that the waterway be small or narrow, and involves considerable labor to erect and maintain the cable system during dredging or harvesting.

There has, thus, evolved a need for a new and improved dredge propulsion system which can be mounted on the watercraft and which avoids the need for connection to the shore. There is further a need for a system for propelling watercraft in shallow water situations which will maintain the position of a dredge or weed harvester despite forces that result from dredging operation or from the environment. Additionally, there is needed a watercraft propulsion system which provides precise positioning in shallow water but is also capable of propelling and maneuvering the watercraft quickly in waterways of any depth. Finally, there is needed a watercraft propulsion system that provides protection and durability of it components when operating on various types of waterways, such as waterways that include cement bottoms.

SUMMARY

Embodiments of the present invention include a watercraft propulsion system for moving a watercraft along a waterway having a bottom and a surface. The watercraft propulsion system comprises a boom assembly having a proximal end and a distal end, with the proximal end being rotatably coupled with the watercraft. The watercraft propulsion system further includes a wheel mounted to the distal end of the boom. The wheel includes at least one generally radially-extending blade assembly, with the blade assembly comprising a primary blade and a secondary blade. The secondary blade extends at an angle with respect to the primary blade so as to present a fluid channel between the primary blade and the secondary blade.

Embodiments of the present invention additionally include a method of propelling a watercraft along a waterway having a bottom and a surface. The method comprising the initial step of providing a rotatable wheel, with the wheel including at least one generally radially-extending blade assembly. The blade assembly comprises a primary blade and a secondary blade, with the secondary blade extending at an angle with respect to the primary blade so as to present a fluid channel between the primary blade and the secondary blade. The method includes the additional step of rotating the wheel within the waterway such that water flows through the fluid channel between an inlet and an outlet of the fluid channel. During the rotating step, the blade assembly is configured such that a static pressure of water flowing through the fluid channel increases as the water flows from the inlet to the outlet.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
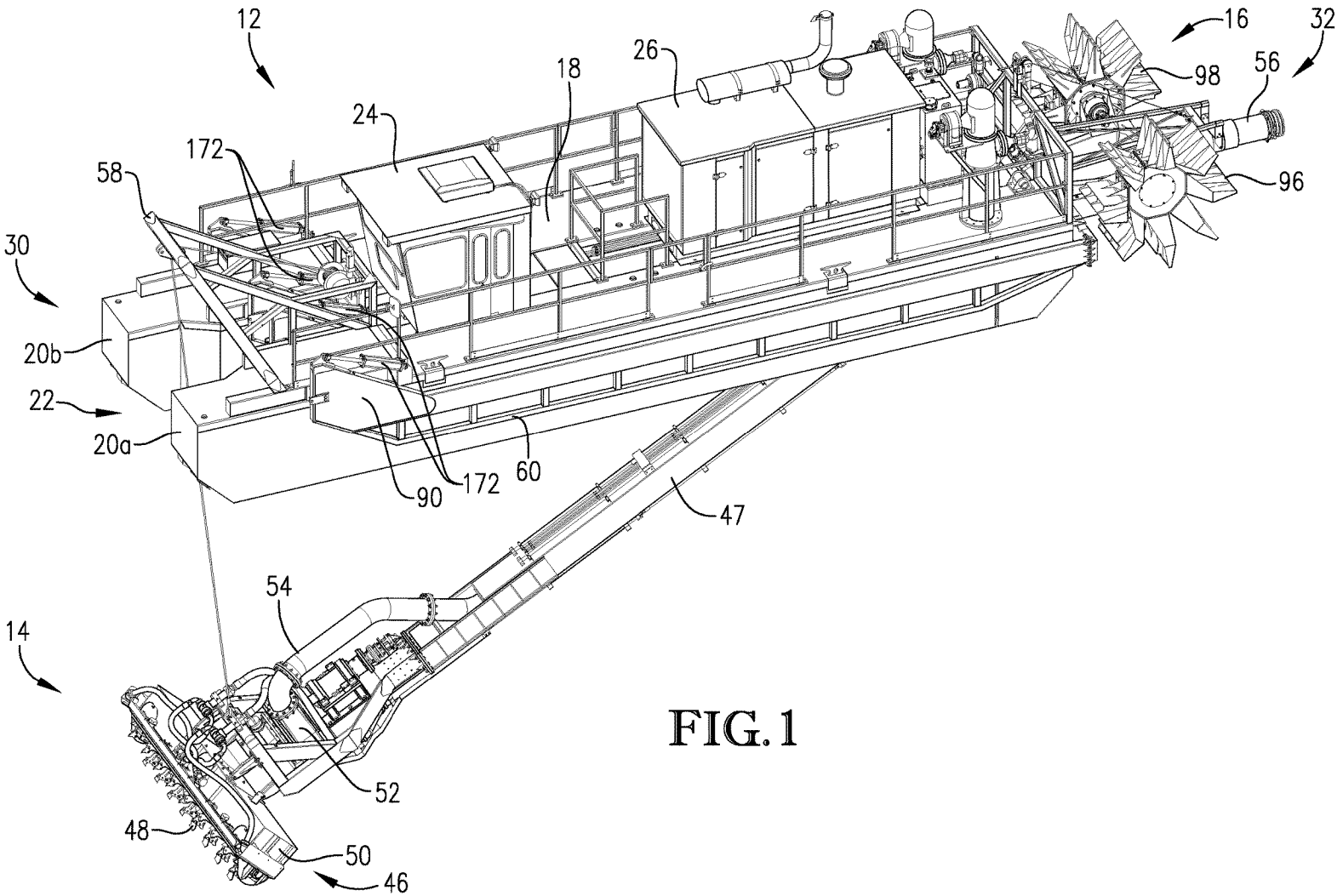
FIG. 1 is a fore, port-side perspective view of a watercraft of embodiments of the present invention, particularly illustrating an excavating system in a lowered position and a propulsion system in a raised position.
Figure 2:
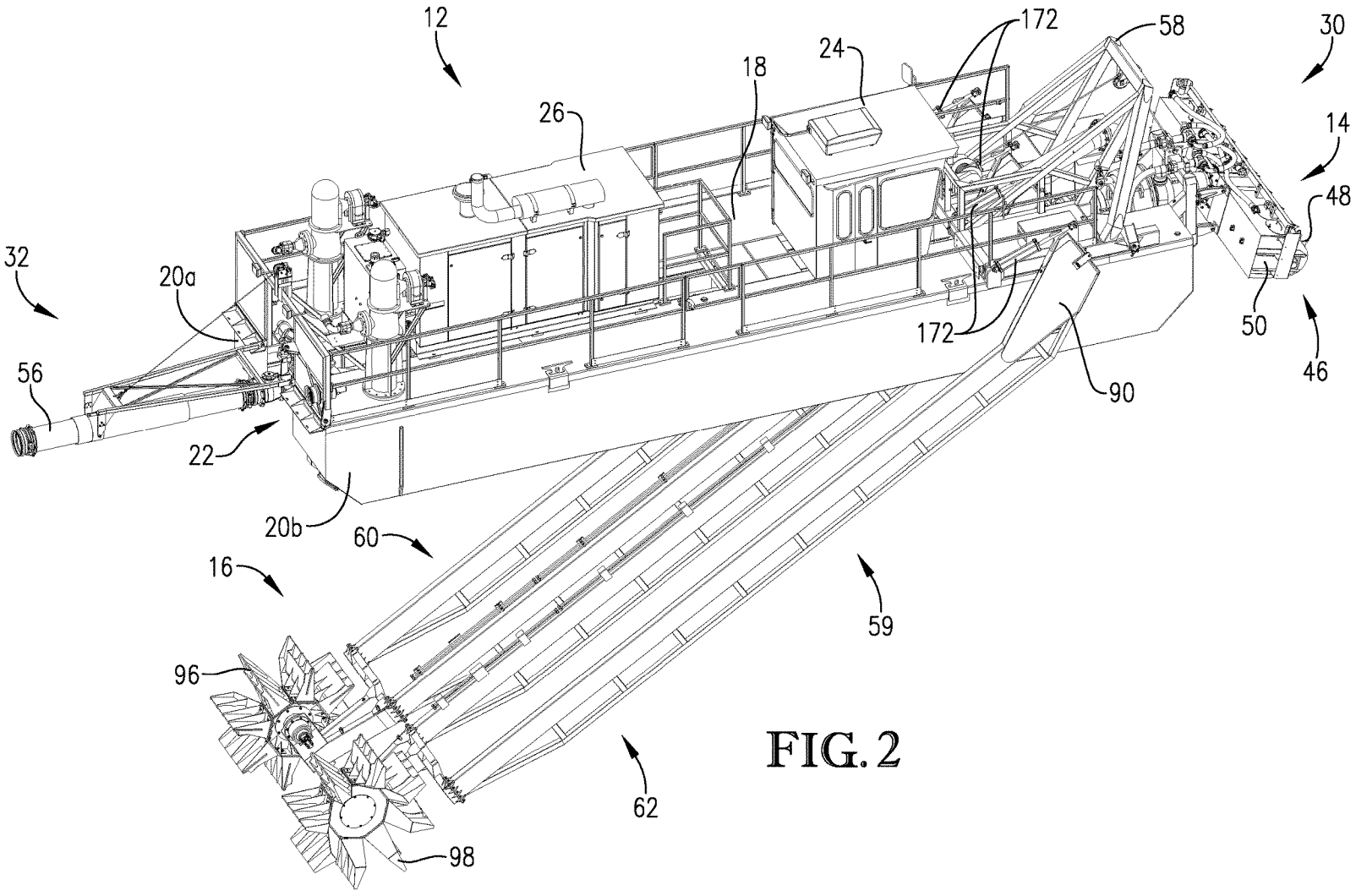
FIG. 2 is an aft, starboard-side perspective view of the watercraft from FIG. 1, particularly illustrating the excavating system in a raised position and the propulsion system in a lowered position.
Figure 3:
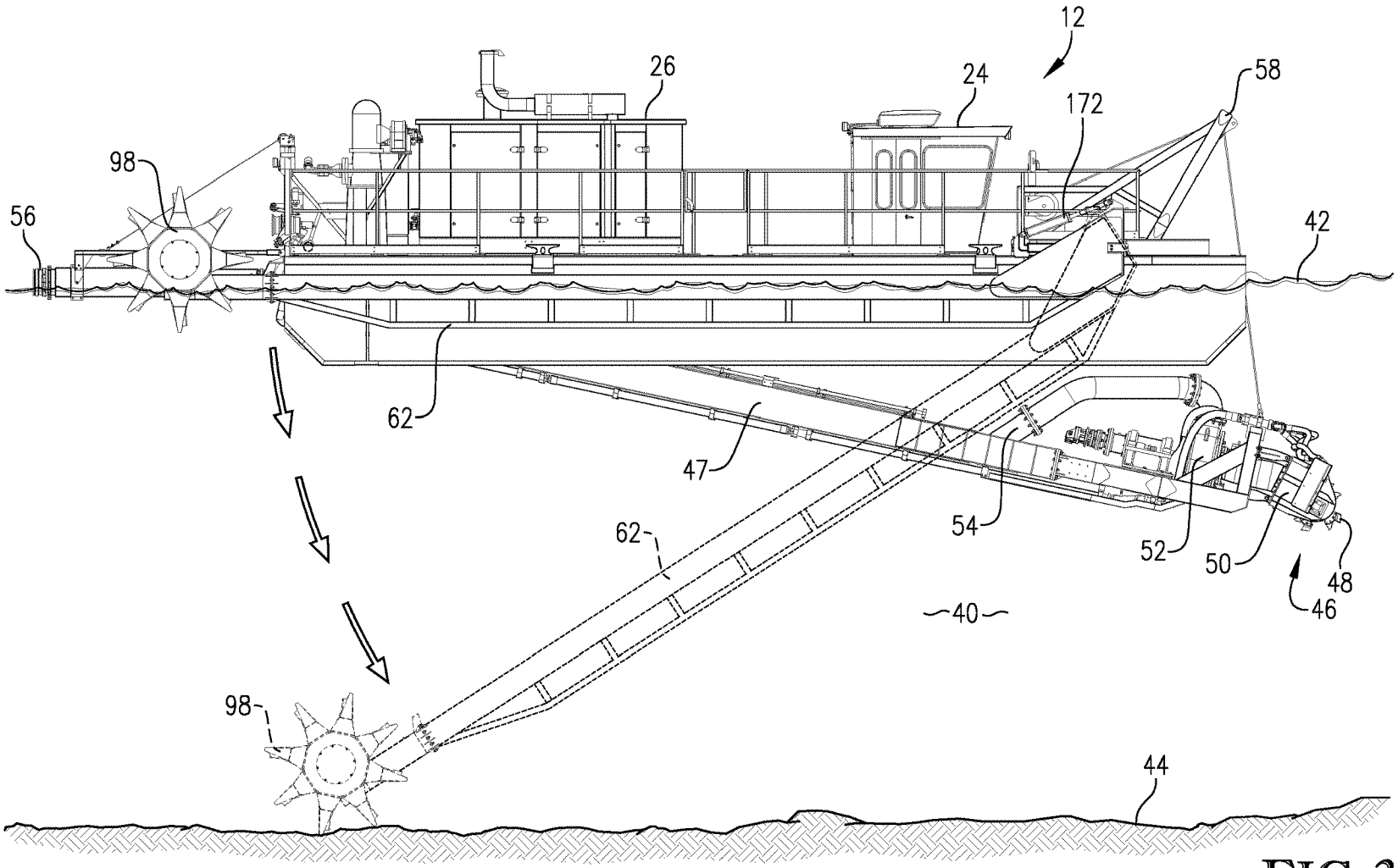
Figure 4:
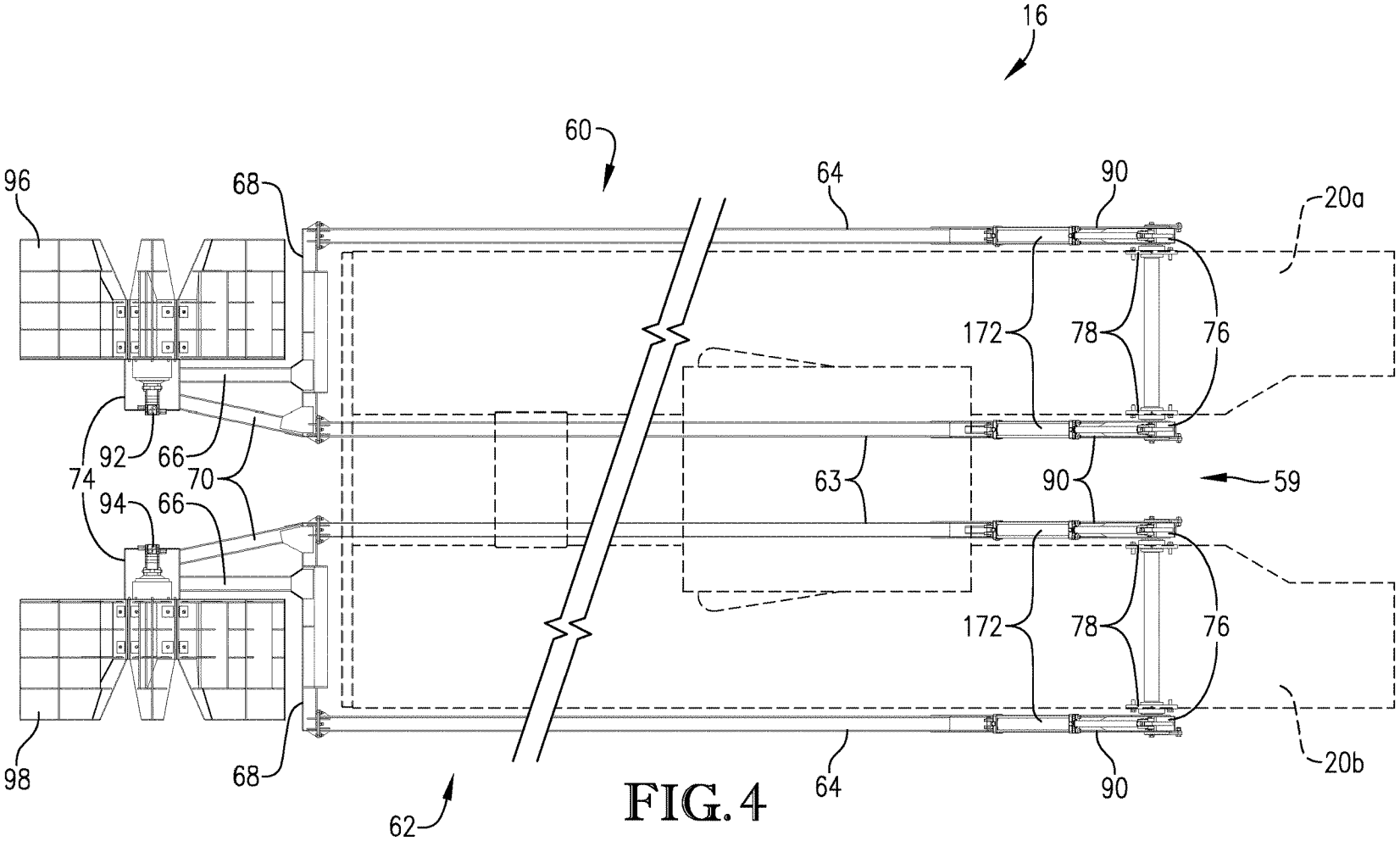
Figure 5:
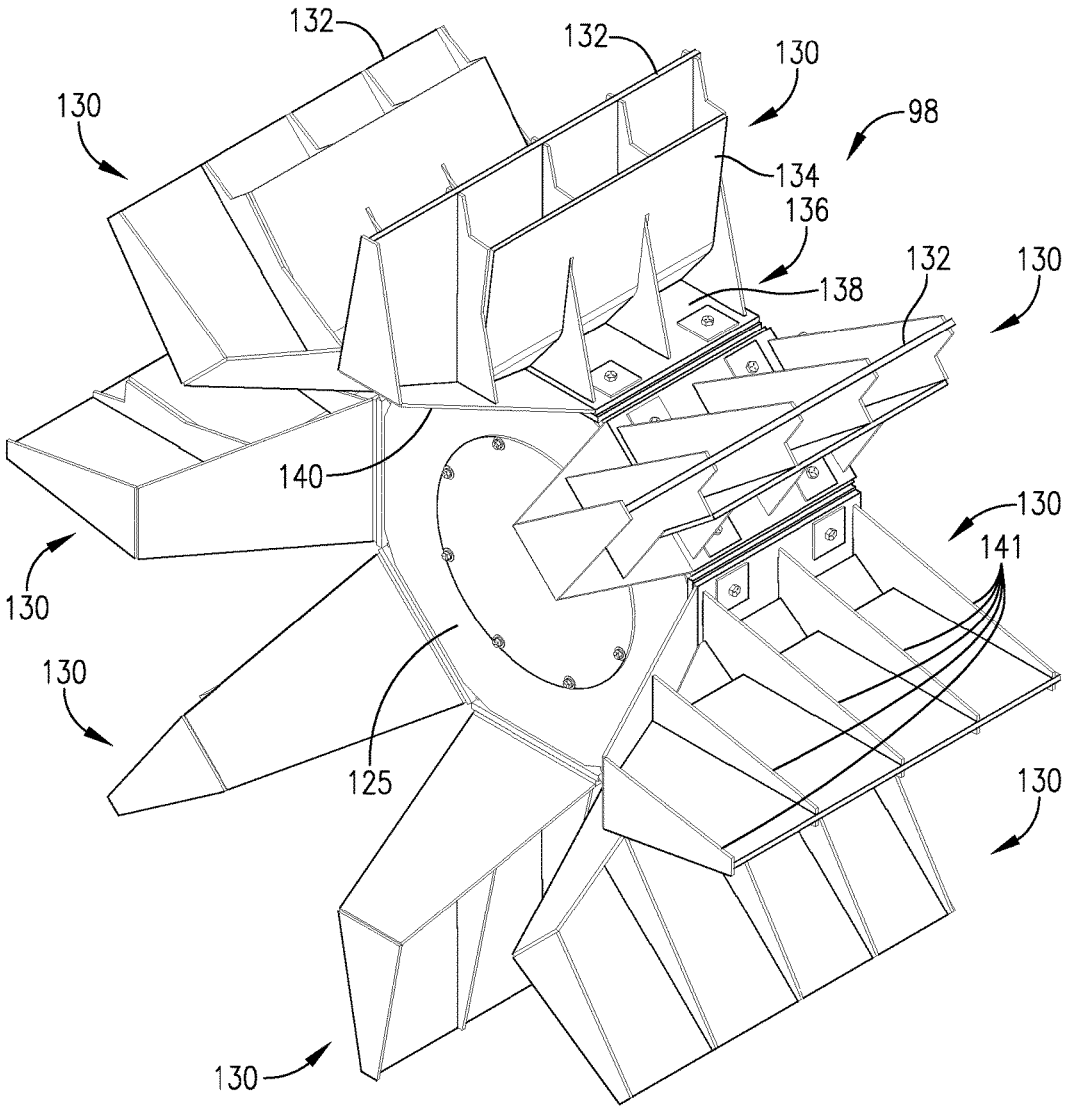
Figure 6:
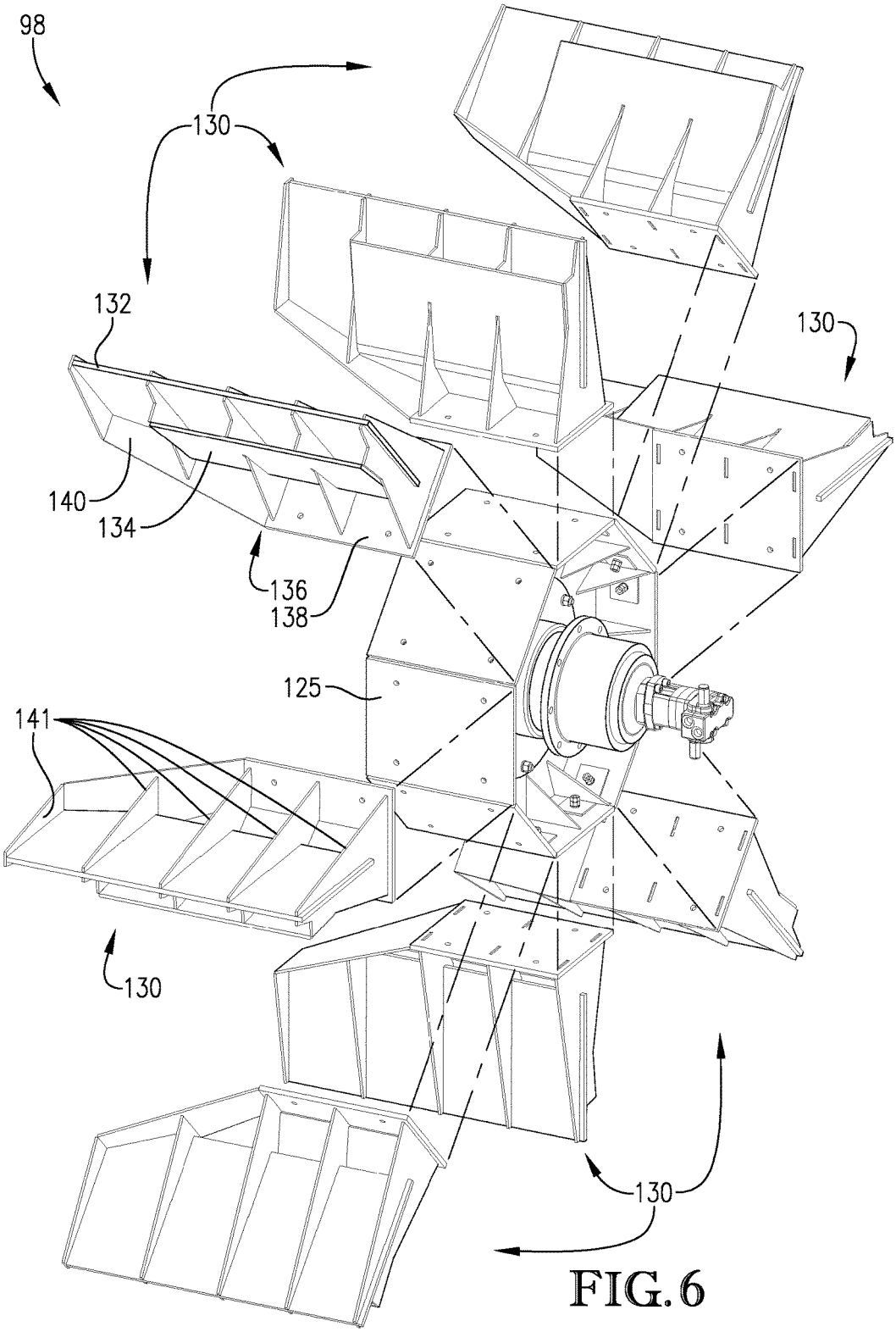
Figure 7:
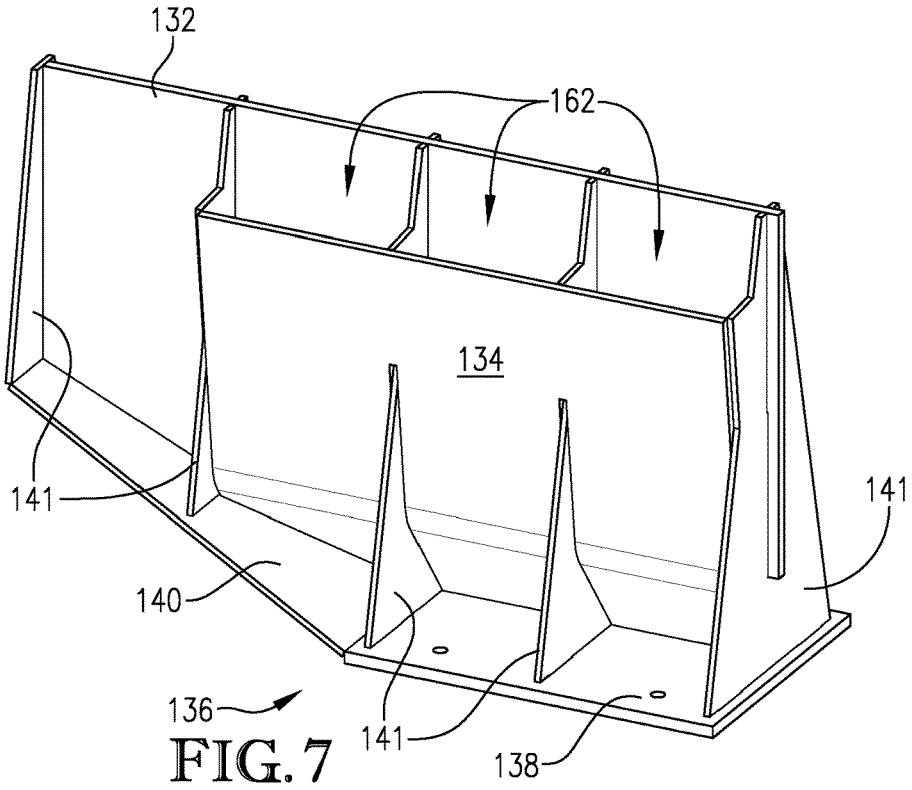
Figure 8:
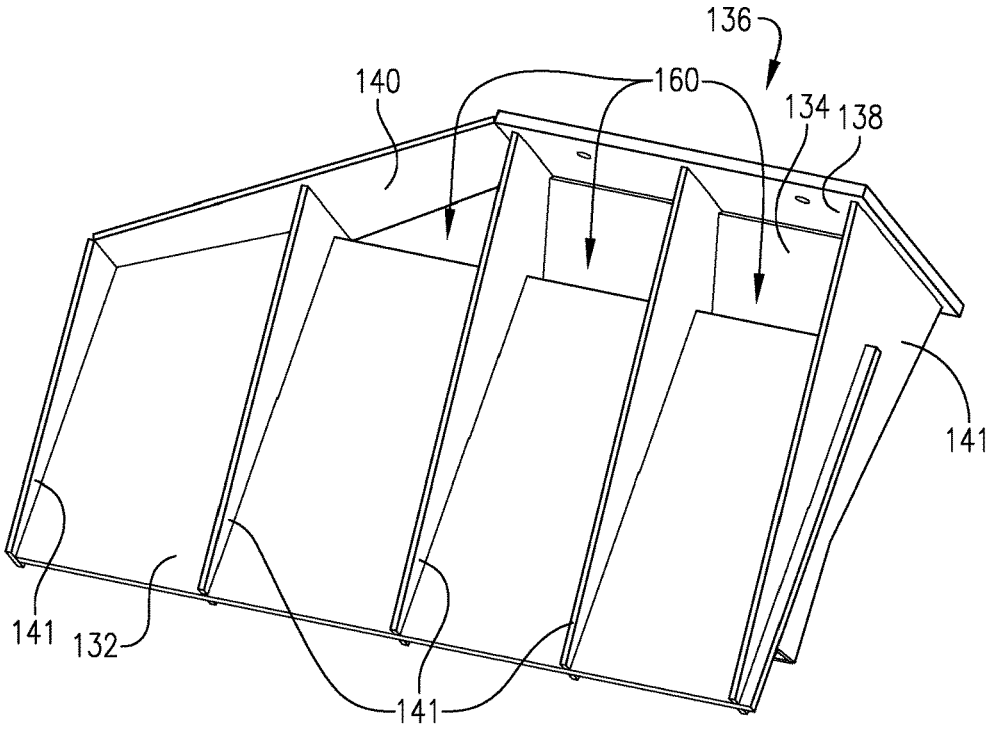
Figure 9:
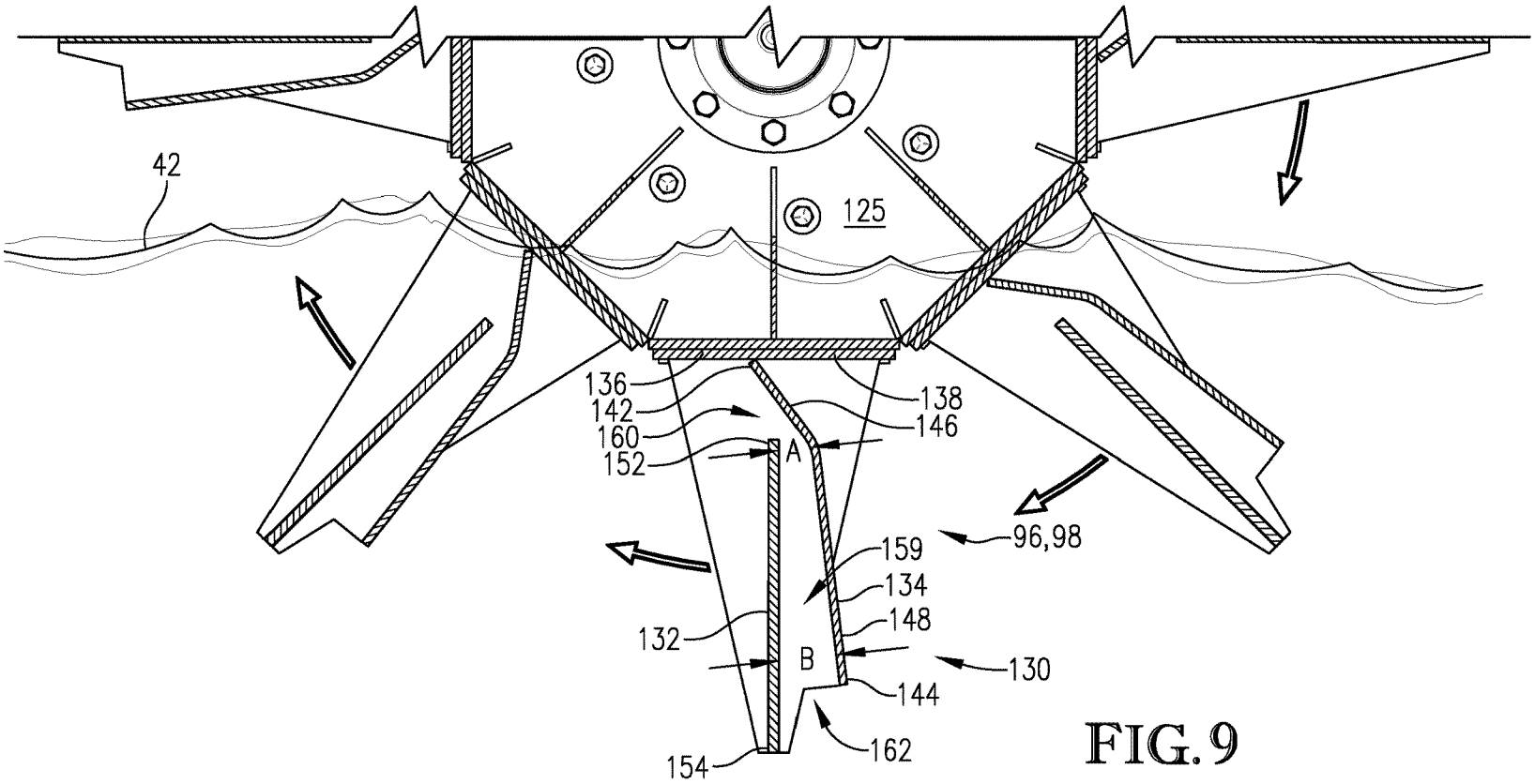
Figure 10:
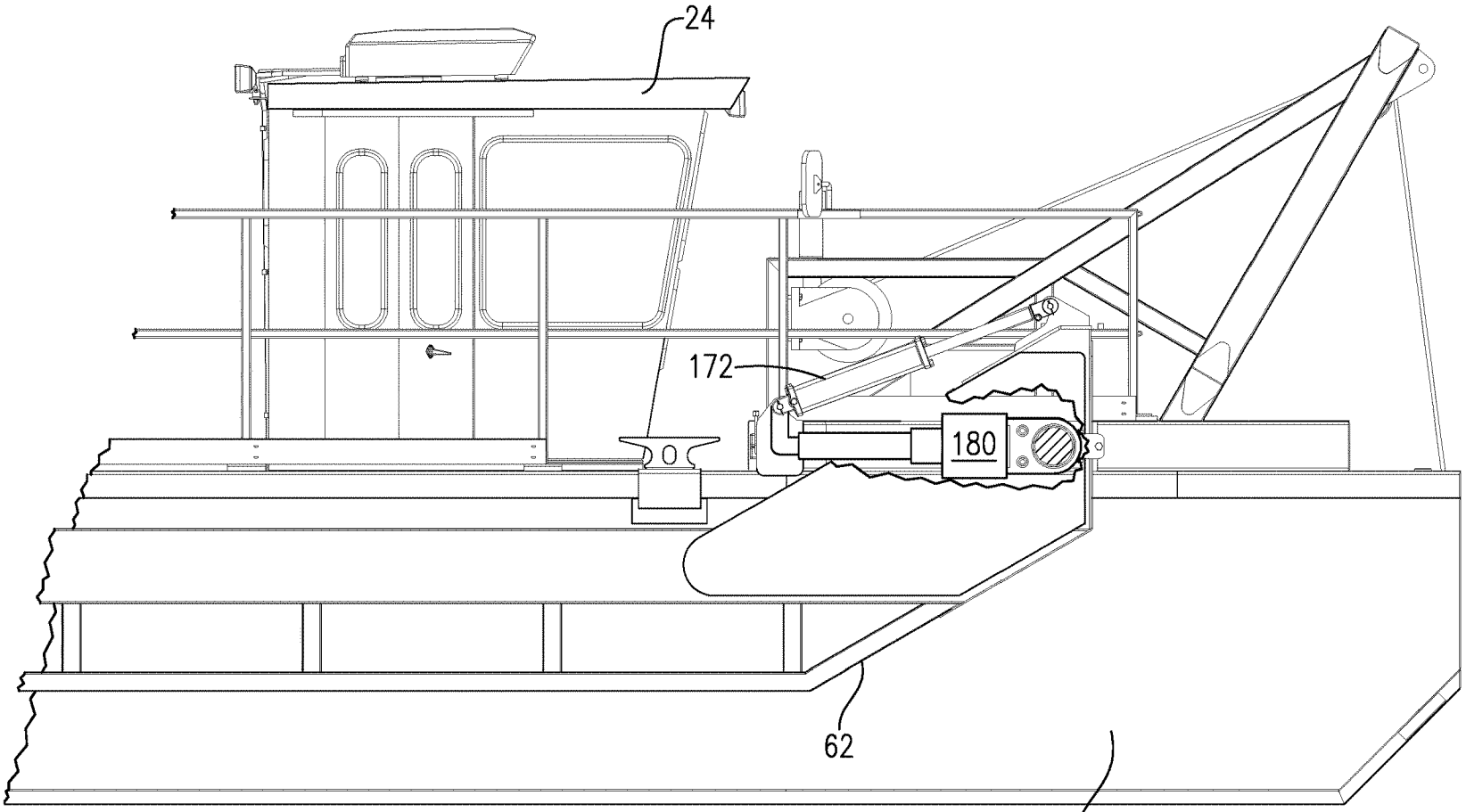
Figure 11:
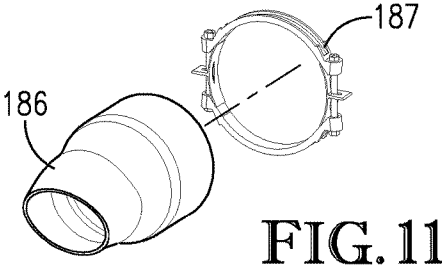
Figure 12:
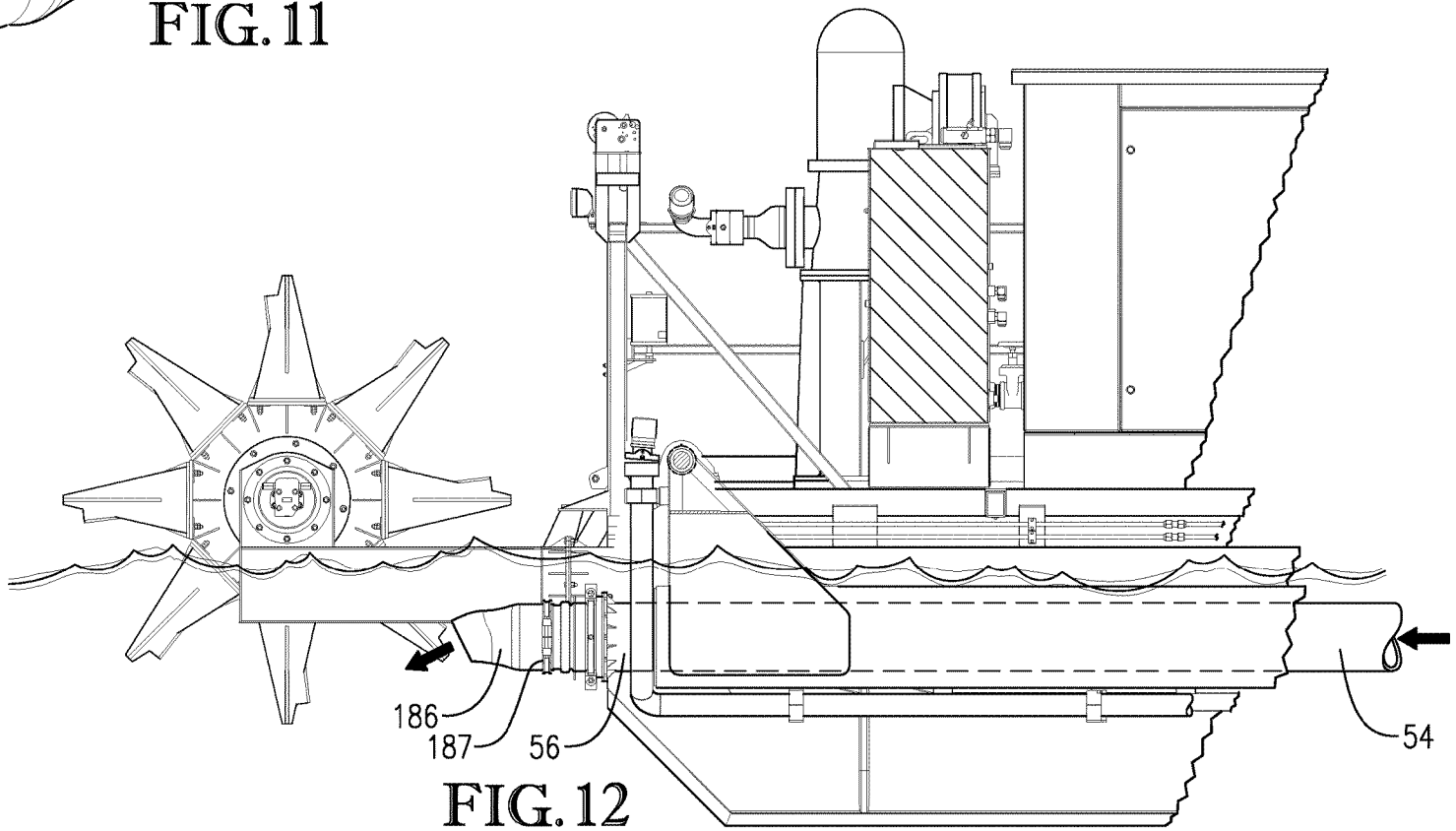
Figure 13:
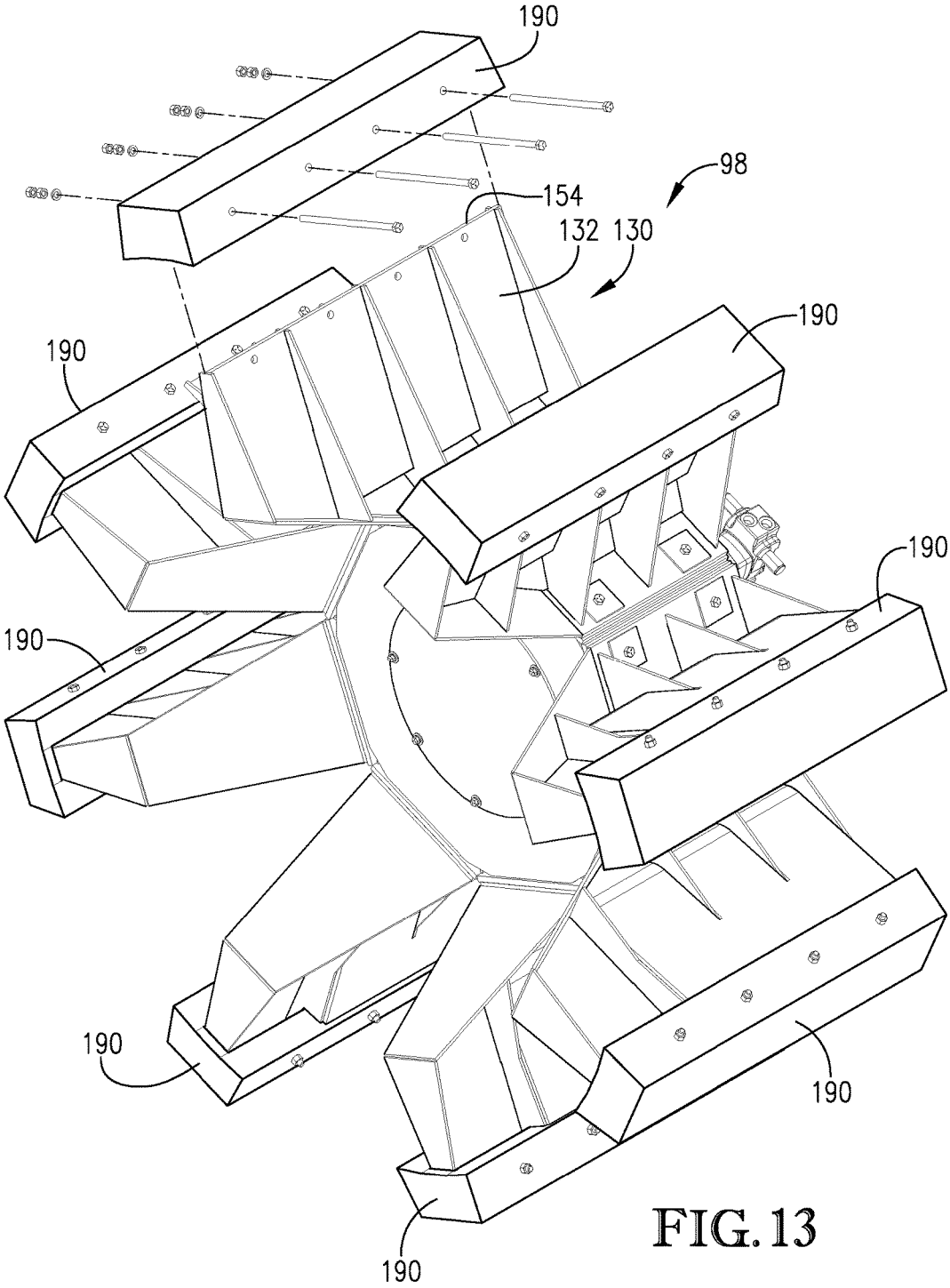

FIG. 3 is a starboard-side elevational view of the watercraft of FIGS. 1-2, with the port side being substantially a mirror image thereof, with the watercraft including a wheel boom assembly shown in solid line in a raised position with a propulsion wheel engaging the surface of the waterway, and with the wheel boom assembly shown in broken line in a lowered position with the propulsion wheel engaging the bottom of the waterway;

FIG. 4 is an enlarged, fragmentary sectional view of the aft section of the watercraft from FIG. 3 taken through port and starboard hulls just below a deck of the watercraft, showing port and starboard booms of the wheel boom assembly being rotatably secured to the hulls at the booms' proximal ends, as well as port and starboard propulsion wheels secured to distal ends of the booms;

FIG. 5 is an outboard perspective view of a propulsion wheel of the watercraft propulsion system of embodiments of the present invention, particularly illustrating a plurality of blade assemblies extending from a hub of the propulsion wheel;

FIG. 6 is an inboard exploded perspective view of the propulsion wheel from FIG. 5, particularly illustrating the blade assemblies separated from the hub;

FIG. 7 is perspective view of a blade assembly from the propulsion wheel from FIGS. 5 and 6, particularly showing a primary blade and a secondary blade and a fluid channel outlet presented between the primary blade and the secondary blade;

FIG. 8 is an opposite-side perspective view of the blade assembly from FIG. 7, particularly illustrating a fluid channel inlet presented between the primary blade and the secondary blade;

FIG. 9 is an elevational partial cross-section view of the propulsion wheel from FIG. 5 shown positioned on the surface of a waterway, particularly illustrating the blade assemblies being rotated through the water of the waterway;

FIG. 10 is a partial starboard-side elevational view of the watercraft from FIG. 3, with a portion of the watercraft cut away to illustrate a position sensor for the wheel boom assembly;

FIG. 11 is a perspective view of a discharge reducer and a ring lock according to embodiments of the present invention;

FIG. 12 is a partial starboard-side elevational view of the aft of a watercraft, particularly illustrating the discharge reducer from FIG. 11 being secured to a discharge end of an excavating system discharge pipe via the ring lock; and FIG. 13 is an outboard perspective view of the propulsion wheel from FIG. 5, including a blade boot positioned on each of the plurality of blade assemblies, with one of such blade boots illustrated being separated from its blade assembly.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Referring now to the drawings, and specifically to FIGS. 1-2, an embodiment of a watercraft 12 according to the present invention is illustrated. The watercraft 12 is a dredge-type vessel that includes an excavating system 14 and a propulsion system 16.

The watercraft 12 comprises a deck 18 which may span twin port (i.e., left) and starboard (i.e., right) hulls 20*a* and 20*b*. An alleyway 22 may be defined between the hulls 20*a* and 20*b* and below the deck 18. The deck 18 may be configured to carry a wheel house 24 which can include controls for the excavating system 14 and the propulsion system 16. In some embodiments, the control for the propulsion system 16 may be a joystick-type control. The watercraft 12 may include a diesel engine 26 that supplies power for the excavating system 14 and the propulsion system 16. In some embodiments, the diesel engine 26 may provide power to the watercraft's 12 main hydraulic pump (not shown). As shown in FIGS. 1 and 2, the watercraft 12 may be configured to present a bow 30 (i.e., a front or fore) and a stern 32 (i.e., a rear or aft). As such, the watercraft 12 can be designed for use as a dredge for removing sediment or for harvesting aquatic weeds from a waterway. For example, as shown in FIG. 3, the watercraft 12 can be used on a waterway 40 presenting a surface 42 and a bottom 44.

As illustrated in FIGS. 1-3, the excavating system 14 may include a cutterhead 46 secured to an end of a cutterhead boom 47. The cutterhead boom 47 may be pivotally mounted to the watercraft 12 adjacent the stern 32 of the watercraft 12. The cutterhead 46 may include a rotatable cutter 48 within a shroud 50, a pump 52 which receives liquid and solid material through an opening in the shroud 50, a discharge pipe 54 fluidly connected to the outlet side of the pump 52 and extending up the cutterhead boom 47 to the stern 32 of the watercraft 12. The discharge pipe 54 may have a typical diameter of eight to twelve inches or more. In some embodiments, a hose (not shown) may be attached to the discharge pipe 54 at a discharge end 56. The hose may also have a typical diameter of eight to twelve inches or more and may be used for delivering dredged material to a barge or shore-based de-wetting location. A winch, cable and pulley assembly 58 may be provided at the bow 30 of the watercraft 12 for raising and lowering the cutterhead 46 as desired for dredging.

With reference to FIGS. 2 and 4, the propulsion system 16 may include a wheel boom assembly 59 comprising port and starboard booms 60 and 62. As illustrated in FIG. 4, the port boom 60 and the starboard boom 62 may be essentially mirror images of one another, each including inboard arm 63, outboard arm 64, aft arm 66, crossbar 68, outer brace 70, and motor carrier 74. The inboard and outboard arms 63, 64 of each boom 60 and 62 may include respective bearings 76 which are pivotally coupled to their respective hull 20*a*, 20*b* by mounting members 78. As such, the booms 60, 62 of the wheel boom assembly 59 are pivotably secured adjacent to the bow 30 of the watercraft 12. The booms 60 and 62 may include a pair of elbows 90 (see, e.g., FIGS. 1 and 2) on the forward portion of the inboard and outboard arms 63, 64 to enhance the ability to position each boom 60, 62 to its fully raised position, as will be discussed in more detail below.

As shown in FIG. 4, the motor carrier 74 of each boom 60, 62 may be configured to mount a respective motor 92, 94. Each motor 92, 94 may be fluidly connected to the main hydraulic pump of the watercraft 12 by hydraulic fluid conduits for supplying hydraulic fluid under pressure for supplying driving power to port and starboard propulsion wheels 96, 98. Each motor 92, 94 may, in some embodiments, be a multi-speed motor capable of operating at two or more drive modes. Specifically, the motors 92, 94 may be configured to operate in a first drive mode, so as to drive the port and starboard propulsion wheels 96, 98 at low-torque and high speeds. In addition, the motors 92, 94 may be configured to operate in a second drive mode, so as to drive the port and starboard propulsion wheels 96, 98 at high-torque and low speeds.

The starboard propulsion wheel 98 of the present invention is shown in more detail in FIGS. 5 and 6. It is understood that the port propulsion wheel 96 is generally configured the same as the starboard propulsion wheel 98, except that the wheels 96, 98 are mirror images of each other. As such, and as illustrated in FIGS. 5 and 6, each propulsion wheel 96, 98 includes a hub 125 to which a plurality of blade assemblies 130 may be removably secured, such as through rivets, nut-bolt combinations, or other similar fasteners. In certain embodiments, portions of the propulsion wheels 96, 98 may be formed from materials having high strength and durability, such as heavy-duty aluminum or other metals. In certain embodiments, the hub 125 may be formed as a hollow enclosure, so as to provide a buoyancy force to at least partially offset the weight of the propulsion wheels 96, 98, motors 92, 94, and/or booms 60, 62 when submerged or when resting on the surface 42 of the waterway 40.

With continued reference to FIGS. 5 and 6, and with further reference to FIGS. 7 and 8, the blade assemblies 130 may each comprise a primary blade 132 and a secondary blade 134 that extend generally radially from the hub 125 and generally parallel with an axis of rotation of the propulsion wheels 96, 98. The primary and secondary blades 132, 134 may be secured to the hub 125 via a base section 136, which may comprise a main portion 138 positioned along the hub 125 and a side portion 140 extending from the hub 125 outwardly in a direction away from the watercraft 12 (i.e., in an outboard direction when the wheels 96, 98 are secured to the watercraft 12 via the booms 60, 62). In some embodiments, the blade assemblies 130 may be secured to the hubs 125 via the main portion 138 of the base section 136. The primary and secondary blades 132, 134 may be interconnected and by way of one or more radially projecting gusset plates 141, which may be oriented perpendicular to the axis of rotation of the propulsion wheel 96, 98. The gusset plates 141 may strengthen the primary and secondary blades' 132, 134 connection with to the hub 125. Furthermore, the gusset plates 141 may also aid in resisting deformation of the blade assemblies 130 and may serve to inhibit movement of the wheels 96, 98, and thus the watercraft 12, in lateral directions (i.e., directions including a component along the axis of the rotation of the wheels 96, 98) due to the force of winds, currents, or the like.

As perhaps best illustrated by FIG. 9, the secondary blade 134 may comprise a first end 142 and a second end 144 and may extend generally radially outwardly from the main portion 138 of the base section 136. In more detail, the secondary blade 134 may have a first portion 146, which includes the first end 142, and which extends from the base section 136 non-radially (with respect to a center of the hub 125). For example, the extension of the first portion 146 of the secondary blade 134 may vary from a radial extension by between 20 and 40°, between 25 and 35°, or about 30°. The secondary blade 134 may further include a second portion 148, which includes the second end 144, and which extends generally radially (with respect to the center of the hub 125) from the first portion 146. In some embodiments, the second portion 148 of the secondary blade 134 may not extend precisely radially with respect the center of the hub 125. The secondary blade 134 may, in some embodiments, have a total length (measured radially) of between 6 and 24 inches, between 10 and 20 inches, between 12 and 18 inches, or about 16 inches. The secondary blade 134 may, in some embodiments, have a maximum width (measured laterally) of between 12 and 48 inches, between 18 and 38 inches, between 20 and 30 inches, or about 23 inches.

Remaining with FIG. 9, the primary blade 132 may include a first end 152 and a second end 154, and may extend generally radially (with respect to the center of the hub 125) along its entire length. In some embodiments, the primary blade 132 may have a length (measured radially) of between 6 and 28 inches, between 12 and 24 inches, between 14 and 18 inches, or about 16 inches. The primary blade 132 may, in some embodiments, have a maximum width (measured laterally) of between 12 and 48 inches, between 18 and 42 inches, between 24 and 34 inches, or about 32 inches.

As illustrated in FIG. 9, the primary blade 132 and the secondary blade 134 are separated from each other along their radial extension, thereby forming a fluid channel 159 therebetween. In some embodiments, one or more of the gusset plates 141 may extend radially through the fluid channels 159. The first end 152 of the primary blade 132 may be spaced apart from the base section 136 and from the secondary blade 134. As such, an initial separation distance A is presented between the first end 152 of the primary blade 132 and the first portion 146 of the secondary blade 134 so as to form an inlet 160 of the fluid channel 159. The inlet 160 is also illustrated in FIG. 8. In some embodiments, the initial separation distance A may be between 0.5 and 8 inches, between 0.75 and 7 inches, between 1.0 and 6 inches, between 1.1 and 3 inches, or about 1.12 inches.

Because the first portion 146 of the secondary blade 134 extends non-radially from the hub 125, the second portion 148 of the secondary blade 134 may, in some embodiments, extend at an angle with respect to the primary blade 132. In some embodiments, such angle may be between 2 and 15°, between 4 and 10°, between 6 and 7°, or about 6.78°. As such, the separation distance between the primary and secondary blades 132, 134 may increase with the blades' 132, 134 radial extensions from the hub 125. Thus, a final separation distance B is presented, as illustrated in FIG. 9, between the second end 154 of the primary blade 132 and the second end 144 of the secondary blade 134 so to form an outlet 162 of the fluid channel 159. The outlet 162 is also illustrated in FIG. 7. As shown in FIG. 9, and as illustrated by the comparison of the inlet 160 and outlet 162 on FIGS. 7 and 8, respectively, because the separation distance between the primary and secondary blades 132, 134 increases with the blades' 132, 134 radial extension, the fluid channel 159 grows in size (i.e., in cross-sectional area) along with the radial extension of the blade assembly 130. As such, the outlet 162 of the fluid channel 159 presents a larger flow area than the inlet 160. In some embodiments, the final separation distance B may be between 1 and 10 inches, between 2 and 5 inches, or about 3 inches.

Embodiments of the present invention provide for the propulsion wheels 96, 98 to have an increased efficiency over propulsion wheels previously used on watercraft. The efficiency of the propulsion wheels 96, 98 may be improved by allowing a portion of the water through which the wheels 96, 98 are rotating to bypass the primary blade 132 and come into contact with the secondary blade 134 to provide a continued propulsion force. In more detail, as the propulsion wheels 96, 98 rotate through the water in the waterway 40 (e.g., clockwise in FIG. 9), the primary blade 132 of one of the blade assemblies 130 will first contact the water and begin to travel through the water, thereby causing propulsion of the watercraft 12 by way of the primary blade 132 acting against the water. However, due to the inlet 160 located between the primary and secondary blades 132, 134, at least a portion of water will pass through the inlet 160, into the fluid channel 159, and come into contact with the second blade 134, thereby causing propulsion of the watercraft 12 by way of the secondary blade 134 acting against the water.

As described above, because the secondary blade 134 extends at an angle with respect to the primary blade 132, the separation distance between the primary and secondary blades 132, 134 increases from the inlet 160 to the outlet 162, such that the cross-sectional area of the fluid channel 159 increases with a radial distance from the hub 125. For example, in some embodiments, the cross-sectional area of the fluid channel 159 adjacent the inlet 160 may be between 20 and 50 square inches, between 30 and 40 square inches, or about 35 square inches. In contrast, the cross-sectional area of the fluid channel 159 adjacent the outlet 162 may be between 40 and 100 square inches, between 60 and 80 square inches, or about 70 square inches As such, when the water flows from the inlet 160 to the outlet 162 (i.e., through the fluid channel 159 presented between the primary and secondary blades 132, 134) the static pressure of the water increases and may be recovered from the water in the result of a greater forward propulsion of the watercraft 12 (e.g., left to right as illustrated in FIG. 9). Specifically, and due to Bernoulli's Principle and Equation, the velocity of the water will slow as it travels through the fluid channel 159 between the inlet 160 and the outlet 162. Such a slowing is due to the increasing cross-sectional area of the fluid channel 159. The slowing of the water causes a corresponding increase in the water's static pressure, which is made available to be applied against the secondary blade 134 to, thereby, generate greater force for a greater propulsion of the watercraft 12. Because pressure is defined as pressure per unit area, the above-described arrangement of the primary and secondary blades 132, 134 that causes an increase in the pressure of the water beneficially provides for an increased 'apparent' surface area of the blade assemblies 130 as they propel the watercraft 12 through the waterway 40.

Returning to FIGS. 1-4, the booms 60, 62 may be raised and lowered so as to raise and lower the propulsion wheels 96, 98 through the use of mechanical actuators, such as hydraulic cylinders 172. The booms 60, 62 each include a proximal end and a distal end, with the proximal ends rotatably connected to the watercraft 12 adjacent the bow 30, as was previously described. The watercraft 12 may include a pair of hydraulic cylinders 172 coupled to each boom 60, 62 and to the watercraft 12, so as to actuate the booms 60, 62 from the raised position to the lowered position, a vice-versa. Specifically, a hydraulic cylinder 172 may be secured to the watercraft 12 and to the inboard arms 63 of each boom 60, 62. Similarly, a hydraulic cylinder 172 may be secured to the watercraft 12 and to the outboard arms 64 of each boom 60, 62. The hydraulic cylinders 172 may be fluidly connected with the watercraft's 12 hydraulic pump so as to provide power to the cylinders 172.

With the booms 60, 62 in a raised position, the propulsion wheels 96, 98 can be used for surface 42 propulsion (as illustrated in FIG. 3, with the boom 62 and the propulsion wheel 98 shown in solid line). Alternatively, with the booms 60, 62 in a lowered position, the propulsion wheels 96, 98 can be used for bottom 44 engaging propulsion (as illustrated in FIG. 3, with the boom 62 and the propulsion wheels 98 shown in broken line). In some embodiments, the watercraft 12 may independently raise and lower each boom 60, 62. In such embodiments, one boom can be raised for surface propulsion, whereas the other boom may be lowered into bottom-engaging position.

In certain embodiments, as illustrated in FIG. 10, the watercraft 12 may include one or more position sensors 180 which are configured to provide an indication of the position of the booms 60, 62 and, thus, the propulsion wheels 96, 98. For instance, the position sensors 180 may provide an indication that the booms 60, 62 are in a raised position (e.g., FIG. 1), which corresponds with the propulsion wheels 96, 98 being raised to a position adjacent with the surface 42 of the waterway 40 (e.g., propulsion wheel 98 of FIG. 3 shown in solid line). In addition, the position sensors 180 may provide an indication that the booms 60, 62 are in a lowered position (e.g., FIG. 2), which may correspond with the propulsion wheels 96, 98 being lowered to a position adjacent with the bottom 44 of the waterway 40 (e.g., propulsion wheel 98 of FIG. 3 shown in broken line). The position sensors 180 may comprise generally any type of position sensor operable to sense the positions of the booms 60, 62 and/or the propulsion wheels 96, 98, such as limit switches, string potentiometers, optical/laser sensors, magnetic sensors (e.g., Hall effect sensors), pressure sensors or the like. For example the position sensors 180 may comprise limit switches positioned on the hulls 20*a*, 20*b* of the watercraft 12 and/or on the booms 60, 62, such that the limit switches can sense whether the booms 60, 62 and/or the propulsion wheels 96, 98 are in either the raised or the lowered position. Alternatively, the position sensors 180 may comprise at least one optical sensor with a first portion positioned on the hulls 20*a*, 20*b* of the watercraft 12 and a second portion positioned on the booms 60, 62, such that the optical sensor can sense whether the booms 60, 62 and/or the propulsion wheels 96, 98 are in either the raised or the lowered position. Alternatively, the position sensors 180 may comprise pressure sensors configured to measure a hydraulic pressure within the hydraulic cylinders 172 so as to determine whether the hydraulic cylinders 172 are supporting the booms 60, 62 and/or the propulsion wheels 96, 98 in the raised position or the lowered position.

In operation, the watercraft 12 may be placed in a shallow waterway 40 having regions of limited depth. The cutterhead 46 may be maintained in a raised position while the propulsion system 16 moves the watercraft 12 to the intended operating location. This may be accomplished with the booms 60 and 62 in the raised position such that the motors 92, 94 can turn their respective propulsion wheels 96, 98 with only the lowermost blade assemblies 130 oriented below the surface 42 of the waterway 40, as illustrated in FIG. 9. It may be preferable to transport the watercraft 12 to a particular operating location while the propulsion wheels 96, 98 are in the raised position because the propulsion wheels 96, 98 can be rotated at a faster speed and can, thus, cause the watercraft 12 to travel at a corresponding faster rate when traveling up or down the waterway 40 to reach the operating location. It should be understood that FIG. 9 illustrates an outboard view of the starboard wheel 98 rotating in a clockwise manner, such that the watercraft 12 (not shown in FIG. 9) would be propelled from left to right. In such a configuration, the primary blade 132 faces in an aft direction so as to allow water to flow into the fluid channel 159 through the inlet 160. Although a similar view of the port wheel 96 is not shown in the drawings, it is understood that its primary blade 132 would also face in an aft direction so as to allow water to flow into the fluid channel 159 through the inlet 160.

Regardless, the direction of rotation of each propulsion wheel 96, 98 may be independently controlled. Thus, the watercraft propulsion system 16 may operate as a stern drive paddlewheel vessel with two independently driven propulsion wheel 96, 98. To turn the watercraft 12, one of the motors 92, 94 is provided more power than the other motor, such that one of the propulsion wheels 96, 98 is caused to actuate at higher revolutions per minute than the other propulsion wheel. In further embodiments, the watercraft 12 can be turned more rapidly by causing forward rotation of one of the propulsion wheels 96, 98, while causing rearward rotation of the other propulsion wheel.

When the watercraft 12 has reached the operating location, the watercraft 12 can begin dredging operations in which the cutterhead 46 is moved to its lowered position in contact with the bottom 44 of the waterway 40. Once in the operating location, to move the watercraft 12 during dredging operations, the propulsion wheels 96, 98 may also lowered to the lowered position where they engage the bottom 44 of the waterway 40. Specifically, the hydraulic cylinders 172 may be activated to lower the booms 60, 62 until the blade assemblies 130 of the propulsion wheels 96, 98 come into contact with and penetrate into the bottom 44 of the waterway 40 (as shown with the broken line propulsion wheel 98 of FIG. 3). If desired, the hydraulic pressure within the hydraulic cylinders 172 may be relaxed, such that the booms 60, 62 may depend freely without tension applied by the hydraulic cylinders 172 so that the propulsion wheels 96, 98 may track along the contours of the bottom 44 of the waterway 40. Significant propulsive force may be required to hold the position of the watercraft 12 against the reactive forces of the cutterhead 46 and any discharge of dredging material. Thus, when dredging materials from a waterway 40, the ability to achieve positive engagement between the propulsion wheels 96, 98 and the bottom 44 provides improved resistance to movement of the watercraft 12 away from the weeds or material to be dredged.

As previously described, certain embodiments may provide for the motors 92, 94 to be multi-speed motors, such that the motors 92, 94 can drive the propulsion wheels 96, 98 at (1) a first drive mode (i.e., low-torque, high speed), and (2) a second drive mode (i.e., high-torque, low speed). In some embodiments, the motors 92, 94 may be in communication with the position sensors 180, such as via an automated control system (electrical, pneumatic, or the like). As such, the motors 92, 94 may be configured to automatically transition between operating the propulsion wheels 96, 98 at the first drive mode and at the second drive mode based on the position of the booms 60, 62 and/or the position of the propulsion wheels 96, 98. Specifically, for instance, when the propulsion wheels 96, 98 are in the raised position (as shown with the solid line boom 62 and propulsion wheel 98 of FIG. 3), the motors 92, 94 may be configured to operate the propulsion wheels 96, 98 at the first drive mode, which is a low-torque, high speed drive mode. Alternatively, when the propulsion wheels 96, 98 are in the lowered position (as shown with the broken line boom 62 and propulsion wheel 98 of FIG. 3), the motors 92, 94 may be configured to operate the propulsion wheels 96, 98 at the second drive mode, which is a high-torque, low speed mode.

In certain embodiments, the sensing performed by the position sensors 180 and the control of the booms 60, 62 and/or the propulsion wheels 96, 98 may be automated, such that the transition between the first and second drive modes is automated based on the position of the booms 60, 62 and/or the propulsion wheels 96, 98 and is, thus, independent of operator inputs. For example, the first drive mode (i.e., low-torque, high speed) of the propulsion wheels 96, 98 may be automatically initiated and operated when the booms 60, 62 and/or the propulsion wheels 96, 98 are in the raised position, so as to ensure the first drive mode is used when the propulsion wheels' 96, 98 are adjacent to the surface 42 of the waterway 40. In some embodiments, the first drive mode may only be automatically selected when the booms 60, 62 and/or the propulsion wheels 96, 98 are sufficiently raised, such that the centerlines of the propulsion wheels 96, 98 are positioned sufficiently above the surface 42 of the waterway 40 (i.e., for surface propulsion). Alternatively, the second drive mode (i.e., low-torque, high speed) of the propulsion wheels 96, 98 may be automatically initiated and operated when the booms 60, 62 and/or the propulsion wheels 96, 98 are in the lowered position, so as to insure the second drive mode is used when the propulsion wheels 96, 98 are positioned adjacent to the bottom 44 of the waterway 40 (i.e., bottom-engaging propulsion). Such features of embodiments of the present invention can function to improve drive efficiencies at both high-speed surface propulsion and lower-speed bottom-engaging propulsion.

The ability of the propulsion system 16 to actuate the propulsion wheels 96, 98 at two or more different drive modes provides precise, consistent watercraft 12 speeds when the propulsion wheels 96, 98 are operating at either the surface 42 or the bottom 44 of the waterway 40. Specifically, when transporting the watercraft 12 along the waterway 40, such as to an operating location, it may be generally preferable for the propulsion wheels 96, 98 to be operating at the surface 42 and at the first drive mode (i.e., low torque, high speed). As such, the propulsion wheels 96, 98 are able to rotate at a high speed to allow the watercraft 12 to traverse the waterway 40 in an expedited manner to the operating location. Alternatively, during dredging operations, it may be preferable for the propulsion wheels 96, 98 to be engaged with the bottom 44 of the waterway 40 and to operate at the second drive mode (i.e., high-torque, low speed). The high-torque functionality provides for a more precise controlled traction drive along the bottom 44 of the waterway 40, such that the precise positioning of the watercraft can be maintained even during operation of the cutterhead 46 and the hose discharge.

As previously mentioned, the propulsion efficiency of the wheels 96, 98 may be further enhanced by the increased 'apparent' surface area of the blade assemblies 130 due to the arrangement of the primary and secondary blades 132, 134. Such increased propulsion efficiency also results in less turbidity, particularly when the wheels 96, 98 are operating at the bottom 44 of the waterway.

Although the propulsion system 16 described above is configured for moving the watercraft 12 during dredging operations and for transporting the watercraft 12 along the waterway 40, it may be beneficial for the watercraft 12 to travel at an even higher rate of speed when travelling long distances. To accomplish such, certain embodiments of the present invention provide a novel configuration of the excavating system 14 to provide additional transportation functionality to the watercraft 12. In more detail, as was described above, during dredging operations, a hose can be connected to the discharge end 56 of the discharge pipe 54 (adjacent to the stern 32 of the watercraft 12). Such a hose can extend to the shoreline to discharge the material being dredged by the cutterhead 46. Embodiments of the present invention provide for the hose to be removed from the discharge end 56 of the discharge pipe 54 and tied off to the rear gantry or otherwise stored on the watercraft 12. In some embodiments, the discharge end 56 of the discharge pipe 54 may include quick-connecting ring lock for quick disconnection and/or connection of the hose. Once the hose has been removed, a discharge reducer 186 (See FIG. 11), may be connected to the discharge end 56 of the discharge pipe 54, as illustrated in FIG. 12. The discharge reducer 186 may be quickly connected to the discharge pipe 54 via the quick-connecting ring lock 187.

As described above, the discharge pipe 54 may have a diameter of eight to twelve inches or more. The discharge reducer 186 may have a size and shape that reduces from the eight to twelve inch diameter of the discharge pipe 54 down to three to eight inches In some embodiments, the discharge reducer 186 may reduce the cross section of the discharge pipe 54 by at least one fourth, one third, one half, two third, or three fourths. As such, with the cutterhead 46 lifted to the raised position, such that it is generally level with the surface 42 of the waterway 40, the pump 52 associated with the cutterhead 46 may be activated so as to force water from the cutterhead 46, along the discharge pipe 54, and out the discharge reducer 186. The velocity of the water exiting from the discharge reducer 186 (i.e., the thrust of the water) will function to propel the watercraft 12 forward. Beneficially, because the discharge reducer 186 reduces the diameter of the discharge pipe 54, the water travelling through the discharge pipe 54 under the power of the pump 52 will be accelerated through the discharge reducer 186, thereby increasing its exit velocity from the watercraft 12 and allowing the watercraft 12 to be propelled at a high rate of speed. While the watercraft 12 is being propelled by the water exiting the discharge reducer 186, the watercraft 12 can be steered by the propulsion wheels 96, 98 as was previously described. Furthermore, the propulsion wheels 96, 98 can be actuated in a reverse direction so as to act as a braking mechanism, to thereby slow the watercraft 12 down and stop it.

Finally, certain embodiments of the present invention provide for the propulsion wheels 96, 98 to include a protection mechanism that protects the blade assemblies 130 and the waterway 40 from causing damage to each other. In more detail, certain types of bottom 44 surfaces of waterways 40 can cause damage to the propulsion wheels 96, 98 when such propulsion wheels 96, 98 engage with the bottom 44 during operation of the watercraft 12. For example, cement-lined canals and lagoons can be a challenge for dredging operations. The hard cement of the bottom 44 can damage the blade assemblies 130 of the propulsion wheels 96, 98. Similarly, portions of the propulsion wheels 96, 98 may be constructed of heavy-duty aluminum or other metals that can chip the cement bottom 44, which is not good for the longevity of the canal.

To alleviate such issues, the protection mechanism may comprise a blade boot 190, as shown in FIG. 13, which is configured to fit over each of the blade assemblies 130 of the propulsion wheels 96, 98. The blade boots 190 may be formed from heavy-duty rubber or other high-durometer material. In some embodiments, the blade boots 190 may be formed from recycled vehicle tire material. Regardless, the blade boots 190 may be configured to fit over the second ends 154 of the primary blades 132 of the blade assemblies 130, where they are held in place by multiple bolts, nuts, and heavy-duty washers. Such bolts may extend through holes formed in the primary blades 132, just below the second ends 154 of the primary blades 132. As such, the blade boots 190 can be efficiently detached and replaced via hand tools, such as wrenches, ratchets, or the like. Given the above-described blade boots 190, the propulsion wheels 96, 98 are capable of traversing a cement-lined bottom 44 of a waterway 40 causing minimal damage to the bottom 44 or to the propulsion wheels 96, 98.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The invention claimed is:

1. A watercraft propulsion system for moving a watercraft along a waterway having a bottom and a surface, wherein said watercraft presents a port side and a starboard side, said watercraft propulsion system comprising:

a boom assembly having a proximal end and a distal end, wherein said proximal end is rotatably coupled with the watercraft;

a first wheel mounted to said distal end of said boom assembly, wherein said first wheel is positioned adjacent to the port side of the watercraft; and a second wheel mounted to said distal end of said boom assembly, wherein said second wheel is positioned adjacent to the starboard side of the watercraft, wherein each of said first wheel and said second wheel includes a plurality of generally radially-extending blade assemblies, with said blade assemblies comprising a primary blade and a secondary blade, wherein for each blade assembly said secondary blade extends at an angle with respect to said primary blade so as to present a fluid channel between said primary blade and said secondary blade.

2. The watercraft propulsion system of claim 1, wherein for each blade assembly a separation distance between said secondary blade and said primary blade increases with a radial extension of said blades.

3. The watercraft propulsion system of claim 2, wherein at an inlet of said fluid channel for each blade assembly, said primary blade and said secondary blade are separated by a first separation distance, wherein at an outlet of said fluid channel, said primary blade and said secondary blade are separated by a second separation distance, with said second separation distance being greater than said first separation distance.

4. The watercraft propulsion system of claim 2, wherein for each blade assembly, said fluid channel includes an inlet and an outlet, wherein said blade assembly is configured such that a static pressure of water flowing through the fluid channel increases as the water flows from said inlet to said outlet.

5. The watercraft propulsion system of claim 1, further comprising motors for supplying driving power to said first wheel and said second wheel.

6. The watercraft propulsion system of claim 5, further comprising a position sensor for sensing a position of said boom assembly, wherein when said boom assembly is in a raised position said motors are configured to automatically operate in a first drive mode, with said first drive mode configured to drive said wheels at low-torque and high speed, wherein when said boom assembly is in a lowered position said motors are configured to automatically operate in a second drive mode, with said second drive mode configured to drive said wheels at high-torque and low speed.

7. The watercraft propulsion system of claim 1, further comprising at least one blade boot configured to be secured to end of a blade assembly of one of the wheels.

8. The watercraft propulsion system of claim 7, wherein said blade boot comprises rubber.

9. The watercraft propulsion system of claim 1, wherein the watercraft is a dredge and includes a cutterhead for excavating material at the bottom of the waterway and expelling such material from a discharge end of a discharge pipe positioned at an aft of the watercraft, wherein said watercraft propulsion system further includes a discharge reducer configured to be received on the discharge end of the discharge pipe.

10. The watercraft propulsion system of claim 9, wherein said discharge reducer reduces a cross-sectional area of the discharge pipe by at least one half.

11. A watercraft propulsion system for moving a watercraft along a waterway having a bottom and a surface, said watercraft propulsion system comprising:

a boom having a proximal end and a distal end, wherein said proximal end is rotatably coupled with the watercraft; and a wheel mounted to said distal end of said boom, wherein said wheel includes at least one generally radially-extending blade assembly, with said blade assembly comprising a primary blade and a secondary blade, wherein said secondary blade extends at an angle with respect to said primary blade so as to present a fluid channel between said primary blade and said secondary blade.

12. The watercraft propulsion system of claim 11, wherein a separation distance between said secondary blade and said primary blade increases with a radial extension of said blades.

13. The watercraft propulsion system of claim 12, wherein said fluid channel includes an inlet and an outlet, and wherein said blade assembly is configured such that a static pressure of water flowing through said fluid channel increases as the water flows from said inlet to said outlet.

14. The watercraft propulsion system of claim 11, further comprising a motor for supplying driving power to said wheel, wherein when said boom is in a raised position said motor it configured to automatically operate in a first drive mode, with said first drive mode configured to drive said wheel at low-torque and high speed, wherein when said boom is in a lowered position said motor is configured to automatically operate in a second drive mode, with said second drive mode configured to drive said wheel at high-torque and low speed.

15. The watercraft propulsion system of claim 11, further comprising at least one blade boot configured to be secured to an end of a blade assembly said wheel.

16. The watercraft propulsion system of claim 11, wherein the watercraft is a dredge and includes a cutterhead for excavating material at the bottom of the waterway and expelling such material from a discharge end of a discharge pipe positioned at an aft of the watercraft, wherein said watercraft propulsion system further includes a discharge reducer configured to be received on the discharge end of the discharge pipe.

17. A method of propelling a watercraft along a waterway having a bottom and a surface, said method comprising the steps of:

(a) providing a rotatable wheel, wherein the wheel includes at least one generally radially-extending blade assembly, with the blade assembly comprising a primary blade and a secondary blade, wherein the secondary blade extends at an angle with respect to the primary blade so as to present a fluid channel between the primary blade and the secondary blade; and (b) rotating the wheel within the waterway such that water flows through the fluid channel between an inlet and an outlet of the fluid channel, wherein during said rotating of step (b), the blade assembly is configured such that a static pressure of water flowing through the fluid channel increases as the water flows from the inlet to the outlet.

18. The method of claim 17, wherein the watercraft includes a boom assembly configured to be selectively positioned in a raised position and a lowered position, wherein the wheel is rotatably secured to an end of the boom assembly, wherein with the boom assembly positioned in the raised position said rotating of step (b) is performed in a first drive mode, with the first drive mode driving the wheel at low-torque and high speed, wherein with the boom assembly positioned in the lowered position said rotating of step (b) is performed in a second drive mode, with the second drive mode driving the wheel at high-torque and low speed.

19. The method of claim 17, further comprising the step of securing a rubber blade boot to an end of the blade assembly.

20. The method of claim 17, wherein the watercraft is a dredge and includes a cutterhead for excavating material at the bottom of the waterway and expelling such material from a discharge end of a discharge pipe positioned at an aft of the watercraft, wherein said method further includes the step of securing a discharge reducer on the discharge end of the discharge pipe to reduce the cross-sectional area of the discharge pipe.

* * * * *